US006179680B1

(12) United States Patent
Hornsby et al.

(10) Patent No.: US 6,179,680 B1
(45) Date of Patent: Jan. 30, 2001

(54) SAFETY DEVICE FOR A SPRING LOADED FLYING TOY

(75) Inventors: Russell Hornsby, St. Louis; Marcellus Rambo Benson, Jr., Chesterfield; James August Keefe, III, Ballwin; Richard Craig Kitchell, Des Peres; Joseph Lee McGowan, St. Peters, all of MO (US)

(73) Assignee: Trendmasters, Inc., St. Louis, MO (US)

( * ) Notice: Under 35 U.S.C. 154(b), the term of this patent shall be extended for 0 days.

(21) Appl. No.: 09/248,799

(22) Filed: Feb. 12, 1999

Related U.S. Application Data

(63) Continuation-in-part of application No. 08/694,616, filed on Aug. 13, 1996, now abandoned.

(51) Int. Cl.[7] ..... A63H 27/14
(52) U.S. Cl. ..... 446/65; 446/63
(58) Field of Search ..... 446/45, 61, 63, 446/64, 65, 429, 430, 486

(56) References Cited

U.S. PATENT DOCUMENTS 1,473,419 * 11/1923 Cudlipp ..... 446/63
1,541,579 * 6/1925 Kikta ..... 446/65
2,976,644 * 3/1961 Crisci ..... 446/65
3,902,271 * 9/1975 Turoff et al. ..... 446/65
3,918,197 * 11/1975 Stanzel ..... 446/65
5,284,454 * 2/1994 Randolph ..... 446/64
5,674,105 * 10/1997 Hamlin ..... 446/430

FOREIGN PATENT DOCUMENTS

449886 * 6/1950 (IT) ..... 446/430
595835 * 7/1959 (IT) ..... 446/63

* cited by examiner

*Primary Examiner*—Jacob K. Ackun
*Assistant Examiner*—Jeffrey D. Carlson
(74) *Attorney, Agent, or Firm*—Dorsey & Whitney LLP

(57) ABSTRACT

The present invention provides an amusement device with a flying member launchable by a hand-held launcher. The launcher includes launching guide rod connected to a handle grip carrying a trigger mechanism with a catch hook. A coil spring is coaxially received on the guide rod. The flying member includes a generally tubular internal support frame, an exterior shell supported by said frame and a latch body connected to the shell for releasably connecting the flying member to the launcher. In use, the frame of the member and the guide rod are aligned coaxially, and the flying member is pushed onto the rod, compressing the spring, until the catch hook of the launcher releasably captures the latch body. When the trigger mechanism is actuated, the flying member is forced off the rod by the spring, taking flight. The connection of the latch body to the shell prevents the launching of the frame without the shell. The invention encompasses a method of making one embodiment of the flying member.

16 Claims, 5 Drawing Sheets

SAFETY DEVICE FOR A SPRING LOADED FLYING TOY

This application is a continuation-in-part of U.S. patent application Ser. No. 08/694,616, filed Aug. 13, 1996 now abandoned.

BACKGROUND OF THE INVENTION

1. Field of the Invention

The present invention relates to toys, games and amusement devices. More particularly, it relates to a toy or amusement device comprising a first part adapted for flight and improved for safety purposes. The invention includes a second part for launching the first part.

2. Description of the Prior Art

Human beings, particularly children, are fascinated by motion, especially flight. There are a myriad of toys and amusement devices adapted to fly. Examples include flying disks, model airplanes, balls, projectiles and other objects designed to be thrown from person to person, or by a person at a target or other receiving structure. The popularity of model airplanes, ranging from simple balsa-wood gliders to radio-controlled, gas or electric powered scale replicas of actual airplanes, manifests our interest in flight.

While some toys and amusement devices adapted, either in whole or part, for flying through the air are launched or thrown by hand, mechanical or electromechanical launching devices are used as well. In some instances, such as in the field of model rocketry, chemical launching means may be used.

One example of a flying toy or amusement device with a flying member is a glider toy, the TEK FIGHTER™, marketed by the assignee of the present invention. The toy includes a separate hand-held, pistol-like launcher and a flyer designed to look like a jet airplane. In use, the glider or flying part of the toy is loaded on the launcher by inserting a launching rod carried by the launcher into the frame of the glider, compressing a coil spring associated with the launcher. When the spring is fully pushed back, an integral flange carried by the frame of the glider engages a trigger clip. To launch the glider, the hand launcher is preferably pointed into the wind (and away from people or animals), and the launching trigger is pulled, removing the clip from engagement with the flange. The coil spring urges the glider rapidly off the rod and it takes flight, performing various aerial maneuvers including climbs, rolls and level long range flight. The glider is equipped with a compressible soft nose cone to reduce landing impact and enhance safe use.

The flying toy described in the preceding paragraph has achieved success in the marketplace, but, as with any launchable projectile toy, it would be desirable to optimize safety.

SUMMARY OF THE INVENTION

The present invention provides an additional safety feature for an amusement device with a flying member. The amusement device includes the flying member and a launcher for propelling the flying member into flight. The safety feature of the present invention is associated with the flying member, more specifically, with the release able interconnection between the member and the launcher.

The launcher includes launching guide rod connected to a handle grip carrying a trigger mechanism with a trigger clip. A coil spring is coaxially received on the guide rod and anchored at one end to the handle.

The flying member of the present invention includes a generally tubular internal support frame, an exterior shell supported by said frame and a latch structure for releaseably coupling or connecting the member to the launcher. The latch structure has a latch body generally conforming to the shape of a portion of the body shell and a distal end provided with a notch or a semi-annular flange. In use, the frame of the member and the guide rod are aligned coaxially, and the flying member is pushed onto the rod, compressing the spring, until the catch hook of the launcher releaseably captures the notch. When the trigger mechanism is actuated, the flying member is strongly urged off the rod by the spring, taking flight. In one embodiment, the shell has the shape of an fighter jet. The latch structure of the present invention is designed to prevent the launching of the frame without the shell, i.e., if the shell is removed from the frame, the launcher will be unable to launch the flying member.

In one embodiment the present invention comprises an amusement device comprising a launcher comprising a pistol grip handle carrying a trigger mechanism, an elongated launching rod extending from the pistol grip handle, the rod having a free end, and a coil launching spring with a free end and a second end connected to the pistol grip handle, said spring positioned around the launching rod and having a compressed charged position and a discharged position wherein the respective free ends of the rod and spring are generally adjacent to each other, and an aircraft having such mass and air foil construction that when launched by the launcher it will glide as a true aircraft and comprising an internal generally tubular support frame with a first end and a second end, an exterior body shell in the shape of an aircraft, said shell mounted on and generally surrounding said support frame, said exterior body shell having a generally tubular fuselage portion having a first end, a second end and a length extending between said ends, said fuselage portion extending substantially coextensively with the support frame whereby the respective first and second ends of the support frame and the shell are generally aligned, and a latch structure for releaseably receiving a portion of the trigger mechanism for releaseably coupling the aircraft to the launcher, said latch structure comprising a body having a first end and a second end wherein the second ends of the latch structure, support frame and shell are generally aligned, the latch structure including an exposed surface generally congruent to the shell, said exposed surface including an area adjacent to the second end for releaseably receiving a portion of the trigger mechanism and releaseably connecting the aircraft to the launcher, said latch structure permanently connected to the shell, whereby if the shell is removed from the support frame, the launcher is unable to launch either of the aircraft and support frame.

The present invention encompasses one embodiment for making an embodiment of the aircraft comprising the steps of providing the generally cylindrical, tubular support frame, a first exterior aircraft body portion and a second exterior aircraft body portion, connecting the first and second aircraft body portions whereby the support frame is substantially encapsulated by the body portions, and mounting the latch structure on the second aircraft body portion for releaseably receiving a portion of the launcher, whereby if the support frame is removed from the body portions, the launcher is unable to launch either the aircraft or the support frame. In one embodiment, the first body portion is generally planar and aircraft shaped including the upper or top portion of an aircraft body, the wings and tail, and the second body portion is shaped like the bottom or underside of the fuselage of the aircraft. Preferably, the latch structure is permanently mounted on the second body portion. The aircraft thus made may be used with the launcher described above.

It is an object of the present invention to provide a safety feature for an amusement device with a flying member.

It is another object of the present invention to provide a safety feature for an amusement device with a flying member, wherein the flying member is launched by a launcher, the safety feature being associated with the flying member and designed to make it difficult to launch the flying member, or a portion thereof, if the flying member is disassembled.

An advantage of the present invention is that the level of safety associated with a product which has achieved success in the marketplace is enhanced without significantly changing the cosmetic appearance and appeal of the product.

These and other objects, features and advantages of the present invention will become more apparent with reference to the drawings, the description of the preferred embodiment and the appended claims.

DETAILED DESCRIPTION OF THE PREFERRED EMBODIMENT

Although in the preferred embodiment of the amusement device of the present invention, the flying member or aircraft of the invention is an airplane (of the jet-fighter type represented in the Figures), it could take the form of any flying member such as other airplanes (biplanes, airliners, transport planes, etc.), rockets, flying disks or saucers, spaceships and the like.

As used herein, the terms "latch" and "latch structure" are intended to encompass any of various devices, and component portions thereof, in which mating mechanical parts engage to temporarily and releaseably fasten. This includes, e.g., a receiving member for releaseably receiving a movable second member, wherein the receiving member has a feature (e.g., a rib. flange, notch or relieved area), usually complementary to at least a portion of the movable member, for receiving it. The terms are also intended to mean to join, couple, catch and/or hold.

With regard to means for fastening, mounting, attaching or connecting the components of the present invention to accomplish the invention as a whole, unless specifically described as otherwise, such means are intended to encompass conventional fasteners such as machine screws, rivets, nuts and bolts, toggles, pins, or the like. Other fastening or attachment means appropriate for connecting components include adhesives, welding (including chemical and sonic welding) and soldering, the latter particularly if the launcher includes any electro-mechanical features or if the flying member includes electrical features such as lights or sensors. Unless specifically otherwise disclosed or taught, materials for making the components of the present invention are selected from appropriate materials such as various plastics (including styrenes), metal and metallic alloys, wood, vinyls, cellulose or paper products and the like.

Figure 1:
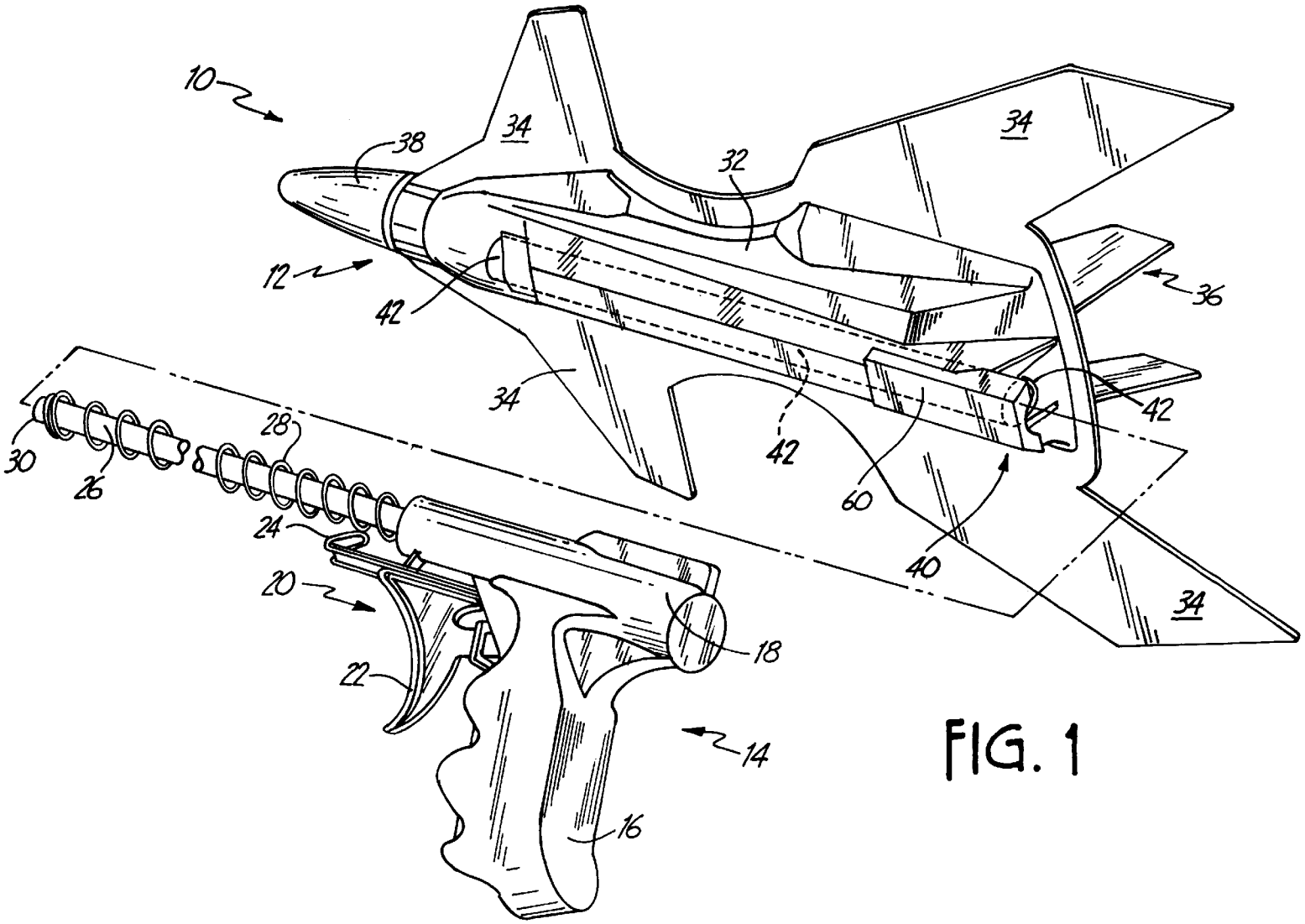
FIG. 1 is a perspective of the amusement device with a flying member of the present invention, depicting the flying member and launcher.

In the following description, any references to right and left, top and bottom, upper and lower and horizontal and vertical are to be read and understood with their conventional meanings and with reference to viewing the present invention as depicted in FIG. 1.

Referring now to the Figures, particularly FIG. 1, the amusement device 10 of the present invention comprises a flying member 12 and a launching component 14. The launching component 14 is generally pistol-shaped and comprises a hand grip 16, a barrel 18 and a trigger mechanism indicated generally at 20. The trigger mechanism 20 is carried at the junction of the hand grip 16 and the barrel 18, and includes a trigger 22 and a trigger clip 24 connected to the trigger 22 for movement therewith. The launching component 14 also includes an elongated cylindrical guide rod 26 coupled to the barrel 18 and extending therefrom. A coil spring 28 is received coaxially about the guide rod 26. The spring 28 includes a fixed end (not shown, but suitably fixed in the barrel 18) and a free end generally adjacent to the free end 30 of the guide rod 26 when the spring 28 is relaxed or extended along the rod 26 as depicted in FIG. 1.

The flying member 12 preferably exhibits the shape of a jet airplane. The member 12 includes a vacuum formed styrene fuselage 32 (the skin or exterior shell forming the generally central body portion of the flying member 12), wings 34, a tail section, indicated generally at 36, and a resiliently compressible rubber nose cone 38. The flying member 12 has an internal generally tubular, elongated frame structure 42 (depicted largely in phantom) inside and extending generally for the length of the fuselage 32 from the tail section 36 to adjacent to the nose cone 38 housing a glue ring and an adjustable balancing flight weight 39 (see FIG. 9). Preferably, the frame 42 is formed of cardboard or pressed board. In the preferred embodiment, the frame 42 is a hollow cylindrical tube having two opposite open ends and a continuous cylindrical wall extending therebetween. The fuselage 32 is adhesively connected to the frame 42 and is supported thereby. The flying member 12 includes a latch structure, indicated generally at 40, complementary and cooperative with respect to the trigger mechanism 20, specifically the trigger clip 24, for releaseably coupling the member 12 to the launching component 14.

Figure 2:
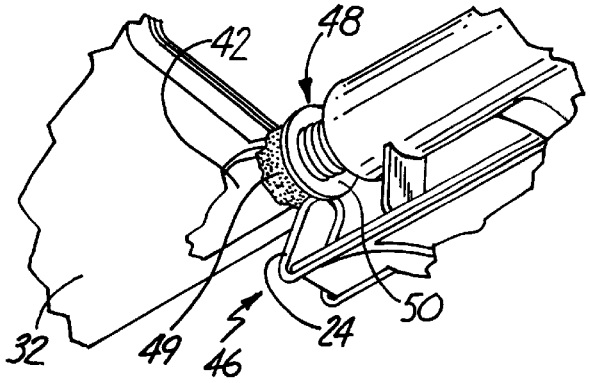
FIG. 2 is a perspective view of a prior art flying toy, particularly the trigger and latch ring thereof.

FIG. 2 depicts a portion of a prior art flying toy marketed by the assignee of the present invention, particularly the lock and release mechanism 46 thereof. The trigger arrangement depicted in FIG. 2 is substantially the same as the trigger mechanism 20 of the launching component 14 depicted in FIG. 1, and is, therefore, commonly numbered. A trigger clip 24 is present. The flying member 12 of the prior art flying toy is depicted only in part, a portion of its fuselage 32 being shown, along with a portion of its internal frame 42. One difference between the prior art flying toy and the amusement device with a flying member of the present invention is that the prior art flying toy includes a launch ring 48 at the rear end of the frame 42. The launch ring 48 is attached directly to the frame 42, not to the fuselage 32 of the prior art flying member, and includes a plug portion 49 and an annular flange 50 for catching the trigger clip 24.

Figure 3:
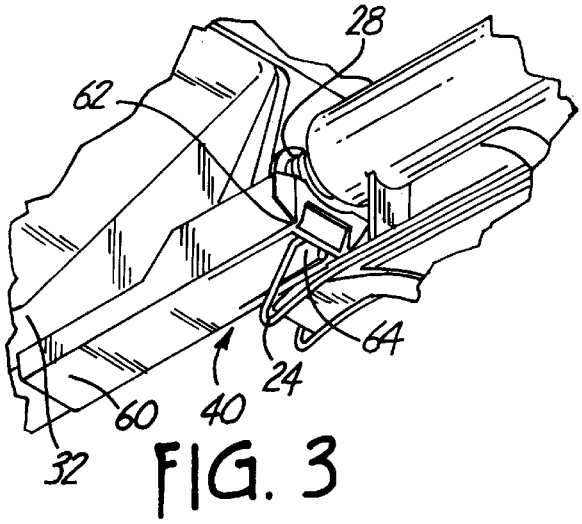
FIG. 3 depicts the trigger mechanism of the present invention, including the trigger clip and latch structure thereof.
Figure 5:
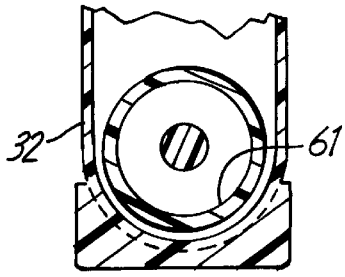
FIG. 5 is a cross sectional view taken along line 5—5 of FIG. 4.
Figure 4:
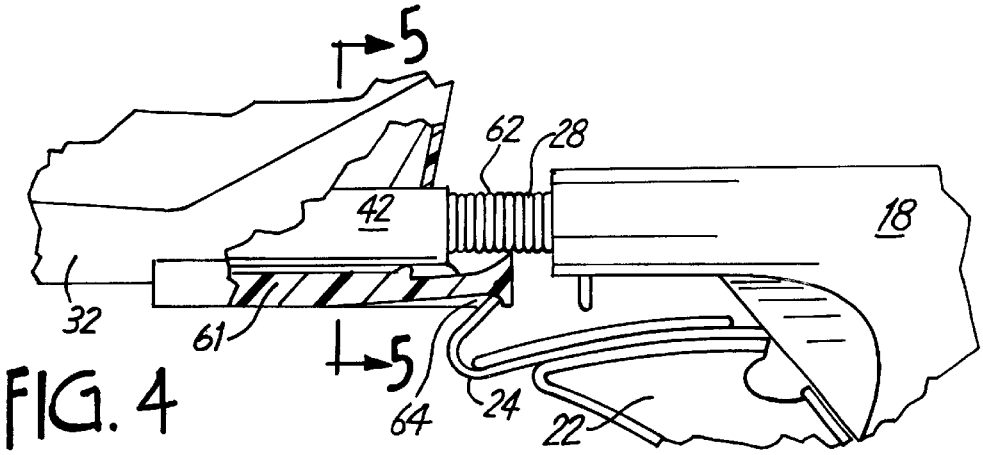
FIG. 4 is an elevational view, partially in section, of the latch structure of the flying member of the present invention.

In contrast to the prior art flying toy depicted in FIG. 2, FIG. 3 depicts the amusement device with a flying member of the present invention and, more particularly, its improved latch structure 40. The latch structure 40 includes a generally elongated latch body 60 having one curved surface 61, the upper surface (see FIGS. 4 and 5) generally conforming to the bottom portion of the fuselage 32 of the flying member 12. At one end, the rearward end, the body 60 carries a distil flange portion 62, including a relieved area 64, for receiving the trigger clip 24. Referring to FIGS. 4 and 5, the latch body 60 is designed to be aligned generally in parallel with the elongated central axis of the flying member 12. FIGS. 4 and 5 also depict that the upper side of the latch body 60 generally conforms to the shape of the underside of the fuselage 32 and is connected to the fuselage 32 of the flying member 12 rather than directly to the internal support frame 42. This connection between the latch structure 40 and the fuselage 32 may be accomplished by mechanical fasteners, sonic welding or suitable adhesives, including those adhesives which create or enable an elastomeric weldment as shown. The latch structure 40 may also be formed (e.g., molded or otherwise shaped) integrally with the fuselage 32. An advantage of this arrangement, wherein the latch body 60 is connected directly to or integrated with the fuselage shell 32 of the flying member 12 rather than to the internal frame 42, is that it makes it difficult to remove the fuselage 32 from the internal frame 42 and then launch or shoot the internal frame 42 alone using the launch mechanism 14. In other words, in contrast to the prior art frame 42 and launch ring 48 (depicted in FIG. 2), the flying member 12 of the present invention, particularly the internal tubular frame 42 thereof, can not be caught by the trigger clip 24 without the fuselage 32 intact on the frame 42.

Figure 6:
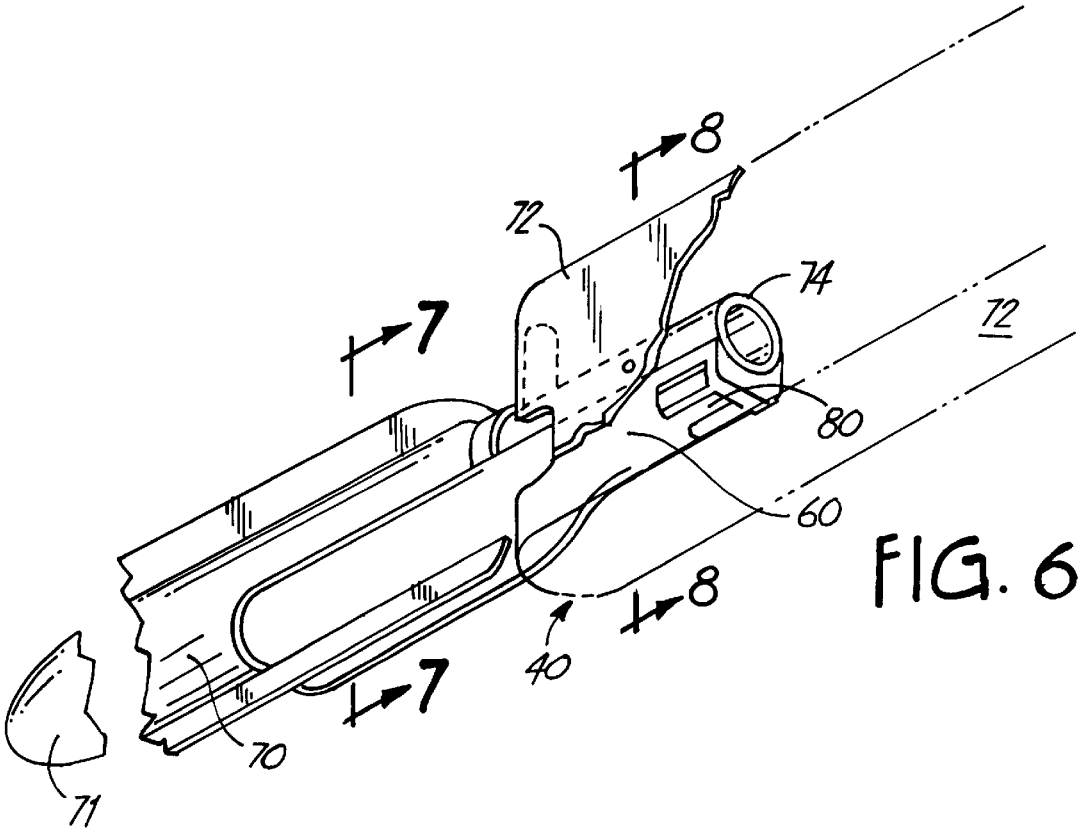
FIG. 6 is a perspective view of a portion of a second embodiment of the flying member, wherein the flying member is in the shape of a helicopter with flexible rotor blades, particularly the latch structure thereof.
Figure 7:
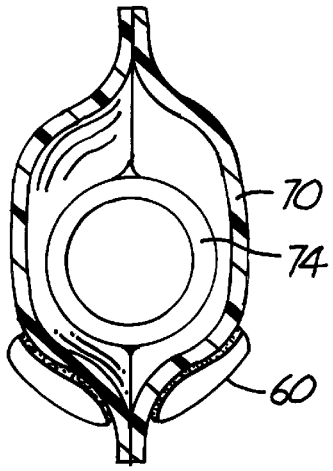
FIG. 7 is a cross sectional view taken along line 7—7 of FIG. 6.
Figure 8:
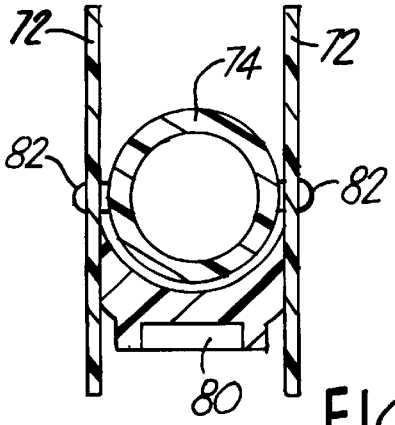
FIG. 8 is a sectional view taken along line 8—8 of FIG. 6.

FIGS. 6–8 depict another embodiment of the present invention, wherein the flying member 12 takes the shape of a helicopter fuselage 70 with a soft nose cone 71 and a pair of flexible rotor blades 72 which deploy or flare when the second embodiment is launched. The launching component 14 described herein above is used to launch the second embodiment. FIG. 6 depicts the latch structure 40 carried by the helicopter fuselage 70, namely the latch body 60. As in the first embodiment, the jet airplane configuration of the present invention (FIG. 1), the helicopter embodiment includes an internal frame 74 to which the helicopter fuselage 70 is attached. FIG. 7 depicts the direct adhesive connection of the latch body 60 to the helicopter fuselage 70, rather than to the internal frame 74. The distal end of the latch body 60, with its trigger clip receiving notch 80, is depicted in FIG. 8, as is the connection of the rotor blades 72 to the frame 74 at pegs 82.

Figure 9:
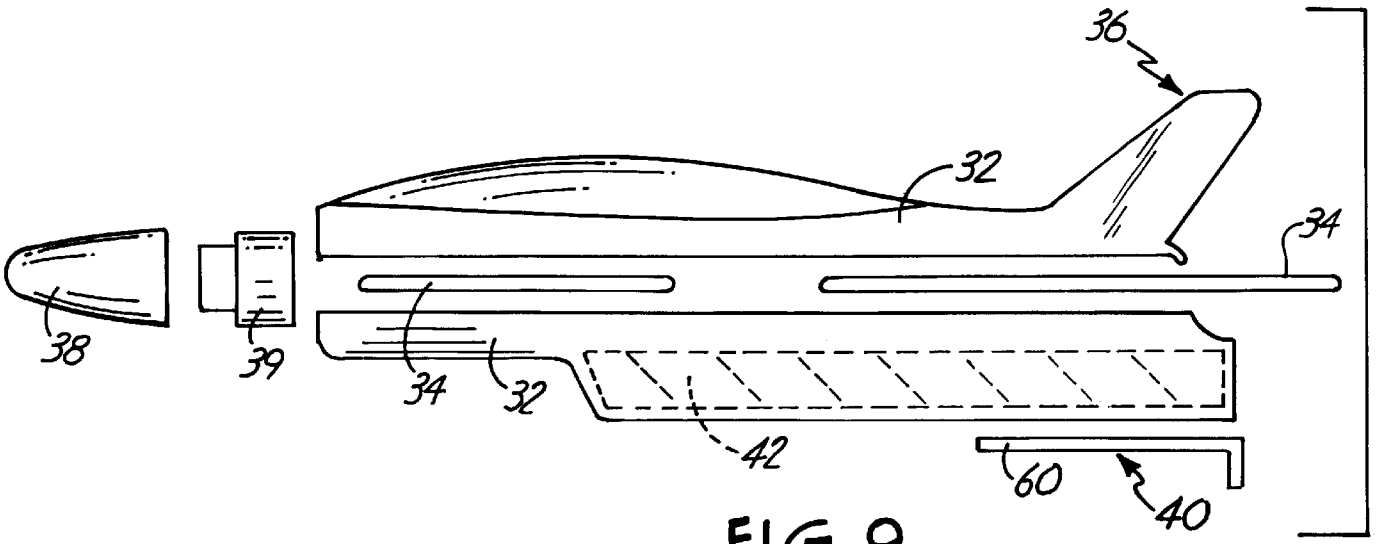
FIG. 9 is an elevational assembly view of the flying member of the present invention, including a second embodiment of the latch structure.
Figure 10:
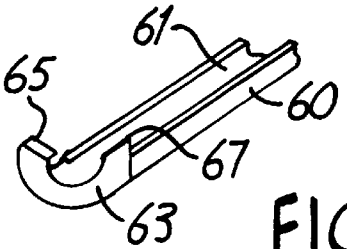
FIG. 10 is a perspective view of the second embodiment of the latch structure of the present invention.

FIGS. 9 and 10 depict another embodiment of the latch structure 40 of the present invention, particularly the latch body 60. Referring to FIG. 10, the latch body 60 of this embodiment is generally semi-cylindrical, with an upper curved surface 61 conforming generally to the underside of the fuselage 32, a lower curved surface generally congruent with the upper surface, and at distal generally semi-annular ring flange 63. Again, an objective of the present invention is to preclude the launching of either the internal frame 42 or the latch body 60 alone, i.e., with the fuselage 32 removed therefrom. This is accomplished as represented in FIG. 9, depicting the latch body 60 for connection or mounting on the outside of the fuselage 32 rather than to the internal frame 42, shown in phantom inside the fuselage 32. Note that the distal or rearward end of the frame 42 does not carry or exhibit an outstanding flange arrangement which might serve to catch the trigger clip 24 (see also FIG. 4). Also, with regard to the embodiment of the latch body 60 depicted in FIG. 10, the two ends 65, 67 of the semi-annular ring flange 63 are generally nonconvergent, i.e., the angular length of the flange 63 is generally 180° or less, so that the latch body 60 can not grip the guide rod 26.

The frame 42 may be formed by web of internal struts; the spring 28 may be replaced by a spring driven mule/track launching system wherein a mule held and guided in a groove on the rod 26 is pushed in the direction of the handle, against a spring, then released to travel rapidly in the direction of the free end of the rod 26 carrying the flying member 12 with it. The spring 28 could be replaced by an stretchable elastomeric member.

Figure 11:
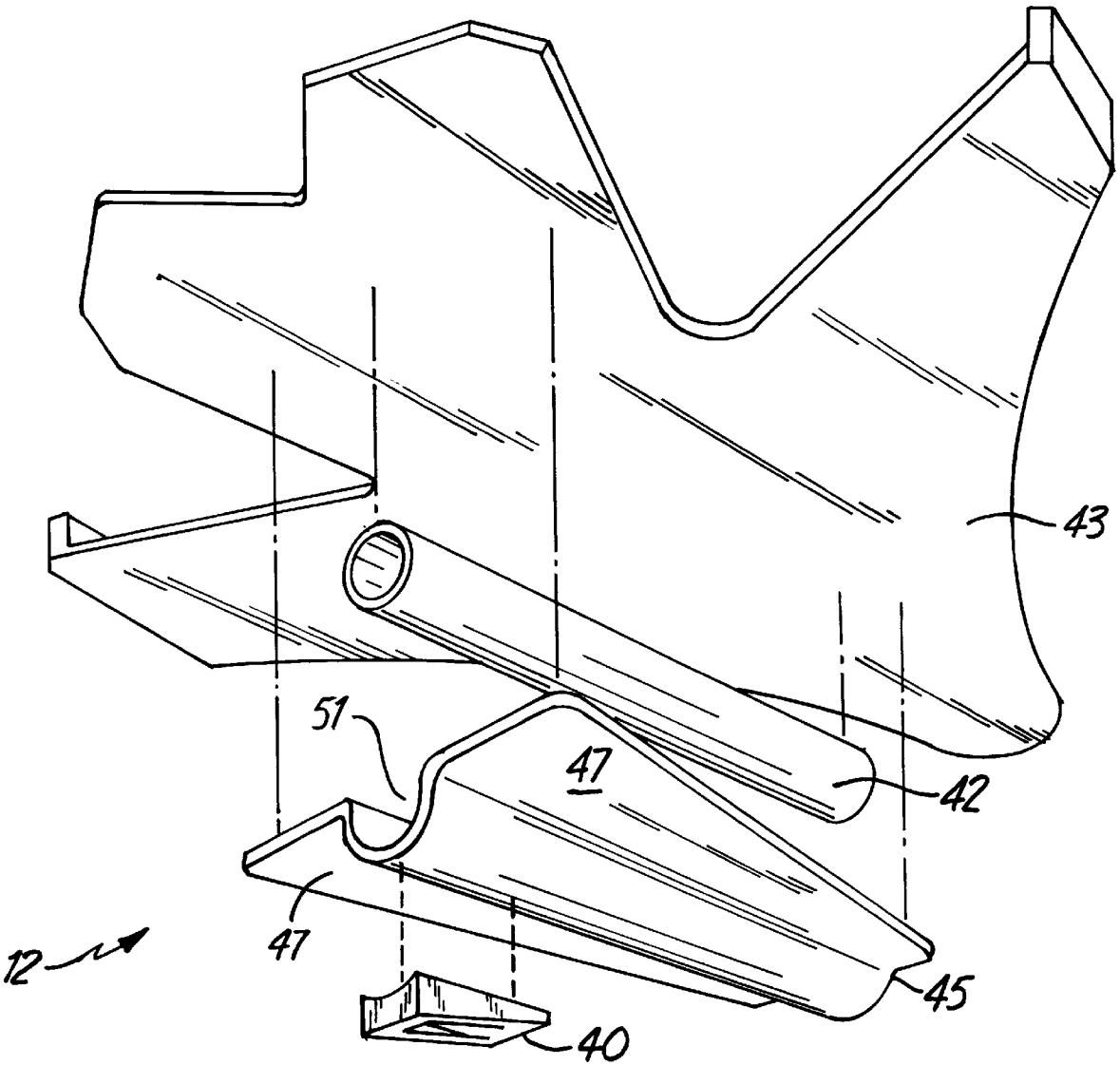
FIG. 11 is an exploded, largely representation view depicting one embodiment of the aircraft of the present invention, and a method of making or assembling it.

FIG. 11 depicts another embodiment of the aircraft 12 of the present invention, and a method of making it. As described above, the frame 42 is an internal generally cylindrical, tubular support frame with a first end and a second end. A first exterior aircraft body portion 43 generally in the shape of an aircraft, i.e., in the shape of the top portion of the fuselage, the wings and tail is provided and positioned generally over the frame 42, with the frame 42 generally aligned with the central longitudinal axis of the body portion 43 (i.e., of the aircraft). A second exterior aircraft body portion 45, shaped generally like the underside or bottom portion of the fuselage of the aircraft and including a pair of side flanges 47 and a central frame accommodating channel 51, is provided and the channel 51 is aligned with the frame 42. A latch structure 40 is provided and mounted on the second body portion 45 near the rear end thereof. Suitable means, e.g., adhesive means, are the used to join the body portions 43, 45, and/or the frame 42 and body portions 43, 45, into a unitary piece, as well as to join the latch structure 40 to the second body portion 45. When this embodiment of the aircraft 12 is finished, the frame 42 is substantially encapsulated by the body portions 43, 45. The body portions 43, 45 may be formed of vacuformed styrene, and it should be appreciated that the second portion 45 and frame 42 could be glued to either side of the top of the portion 43 to form either the top or the underside of the fuselage of the aircraft 12.

Referring to FIG. 1, in use, the flying member or aircraft 12, specifically the frame 42 thereof, is aligned coaxially with the guide rod 26 of the launcher 14. The flying member 12 is pushed onto the guide rod 26 in the direction of the barrel 18 until the trigger clip 24 engages the latch body 60. In this position, shown in FIG. 3, the flying member or aircraft 12 is ready to be launched into flight. The trigger 22 is pulled and the spring 28 extends, rapidly urging the aircraft 12 off the guide rod 26 and into flight.

Although a description of a preferred embodiment has been presented, various changes, including those mentioned above, could be made without deviating from the spirit of the present invention. It is desired, therefore, that reference be made to the appended claims rather than to the foregoing description to indicate the scope of the invention.

What is claimed is:

1. A method of making an aircraft for an amusement device comprising the aircraft and a launcher for launching the aircraft, said method comprising the steps of:

providing a generally cylindrical, tubular support frame with a first end and a second end;

providing a first exterior aircraft body portion;

providing a second exterior aircraft body portion;

adhesively connecting said first and second aircraft body portions whereby said support frame is substantially encapsulated by the body portions; and mounting a latch structure on said second aircraft body portion for releaseably receiving a portion of the launcher, whereby if the support frame is removed from the body portions, the launcher is unable to launch either the aircraft or the support frame.

2. The method according to claim 1, wherein the first body portion is generally aircraft shaped.

3. The method of claim 1, further comprising adhesively connecting the support frame to the first or the second aircraft body portion.

4. The method of claim 1, wherein the first exterior aircraft body portion has a bottom portion having a substantially flat surface, and wherein the second exterior aircraft body portion has a top portion having a substantially flat surface, and wherein the step of adhesively connecting the first and second aircraft body portions comprises applying an adhesive to the substantially flat surface of the top portion or to the substantially flat surface of the bottom portion; and connecting the substantially flat surface of the top portion to the substantially flat surface of the bottom portion.

5. The method of claim 4, wherein the second exterior aircraft body portion has a top portion that defines a frame accommodating channel that receives the frame.

6. The method of claim 5, further comprising adhesively connecting the support frame to the first or the second aircraft body portion.

7. The method of claim 5, further comprising adhesively connecting the support frame to the frame accommodating channel of the top portion of the second exterior aircraft body portion.

8. A method of making an aircraft for an amusement device comprising the aircraft and a launcher for launching the aircraft, wherein said launcher includes a pistol grip handle carrying a trigger mechanism, an elongated launching rod extending from the pistol grip handle, the rod having a free end, and a coil launching spring with a free end and a second end connected to the pistol grip handle, said spring positioned around the launching rod and having a compressed charged position and a discharged position wherein the respective free ends of the rod and spring are generally adjacent to each other, the method of making the aircraft comprising the steps of:

providing an internal generally cylindrical, tubular support frame with a first end and a second end;

providing a first exterior aircraft body portion generally in the shape of an aircraft;

providing a second exterior aircraft body portion;

adhesively connecting said first and second aircraft body portions whereby said support frame is substantially encapsulated by the body portions; and mounting a latch structure on said second aircraft body portion for releaseably receiving a portion of the trigger mechanism for releaseably coupling the aircraft to the launcher, whereby if the body portions are removed from the support frame, the launcher is unable to launch either of the aircraft and support frame.

9. The method of claim 8, wherein the latch structure is permanently mounted on the second body portion.

10. The method of claim 8, further comprising adhesively connecting the support frame to the first or the second aircraft body portion.

11. The method of claim 8, wherein the first exterior aircraft body portion has a bottom portion having a substantially smooth surface, and wherein the second exterior aircraft body portion has a top portion having a substantially smooth surface, and wherein the step of adhesively connecting the first and second aircraft body portions comprises:

applying an adhesive to the substantially smooth surface of the top portion or to the substantially smooth surface of the bottom portion; and connecting the substantially smooth surface of the top portion to the substantially smooth surface of the bottom portion.

12. The method of claim 11, wherein the substantially smooth surfaces of the bottom and top portions of the first and second aircraft body portions are substantially flat.

13. The method of claim 12, wherein the second exterior aircraft body portion has a top portion that defines a frame accommodating channel that receives the frame.

14. The method of claim 13, further comprising adhesively connecting the support frame to the first or the second aircraft body portion.

15. The method of claim 13, further comprising adhesively connecting the support frame to the frame accommodating channel of the top portion of the second exterior aircraft body portion.

16. The method of claim 15, wherein the latch structure is permanently mounted on the second body portion.

* * * * *